US005409620A

United States Patent [19]

Kosal et al.

[11] Patent Number: 5,409,620

[45] Date of Patent: Apr. 25, 1995

[54] FIBER TREATMENT COMPOSITIONS CONTAINING ORGANOFUNCTIONAL SILOXANES AND METHODS FOR THE PREPARATION THEREOF

[75] Inventors: Jeffrey A. Kosal; Diane M Kosal, both of Midland; Anthony Revis, Freeland, all of Mich.

[73] Assignee: Dow Corning Corporation, Midland, Mich.

[21] Appl. No.: 175,807

[22] Filed: Dec. 30, 1993

[51] Int. Cl.[6] ..... B32B 27/36; D06C 15/00; D06M 11/77

[52] U.S. Cl. ..... 252/8.6; 252/8.9; 106/287.11; 106/287.12; 106/287.13; 106/287.14; 106/287.15; 106/287.16; 528/15; 528/26; 524/773; 524/765; 524/755; 524/714; 524/792

[58] Field of Search ..... 106/287.11, 287.12, 106/287.13, 287.14, 287.15, 287.16; 252/8.6, 8.9, 308, 315.1, 351, 357, 356; 528/15, 26; 524/773, 765, 755, 714, 792

[56] References Cited

U.S. PATENT DOCUMENTS

| | | | |
|---|---|---|---|
| 2,823,218 | 2/1958 | Speier | 260/448.2 |
| 3,159,601 | 12/1964 | Ashby | 260/46.5 |
| 3,159,602 | 12/1964 | Hamilton | 260/61 |
| 3,220,972 | 11/1965 | Lamoreaux | 260/46.5 |
| 3,296,291 | 1/1967 | Chalk | 260/448.2 |
| 3,419,593 | 12/1968 | Willing | 260/448.2 |
| 3,516,946 | 6/1970 | Modic | 252/429 |
| 3,814,730 | 6/1974 | Karstedt | 260/46.5 |
| 3,876,459 | 4/1975 | Burrill | 117/141 |
| 3,928,629 | 12/1975 | Chandra | 427/387 |
| 4,098,701 | 7/1978 | Burrill | 252/8.6 |
| 4,154,714 | 5/1979 | Hockemeyer | 260/31.2 R |
| 4,177,176 | 12/1979 | Burrill | 260/29.2 |
| 4,380,367 | 4/1983 | Suzuki | 106/287.14 |
| 4,472,551 | 9/1984 | White et al. | 524/728 |
| 4,746,750 | 5/1988 | Revis | 556/443 |
| 4,933,002 | 6/1990 | Petroff | 71/116 |
| 4,954,401 | 9/1990 | Revis | 428/412 |
| 4,954,554 | 9/1990 | Bunge | 528/338 |
| 4,954,597 | 9/1990 | Revis | 528/15 |
| 5,000,861 | 3/1991 | Yang | 252/8.6 |
| 5,017,297 | 5/1991 | Spyropoulos | 252/8.8 |
| 5,063,260 | 11/1991 | Chen | 523/213 |
| 5,066,699 | 11/1991 | Lee | 524/379 |
| 5,077,249 | 12/1991 | Lee | 502/5 |
| 5,082,735 | 1/1992 | Revis et al. | 428/412 |
| 5,095,067 | 3/1992 | Hara et al. | 524/506 |
| 5,104,927 | 4/1992 | Hara et al. | 524/731 |
| 5,194,460 | 3/1993 | Evans | 523/211 |

*Primary Examiner*—Mark L. Bell
*Assistant Examiner*—C. Bonner
*Attorney, Agent, or Firm*—Timothy J. Troy

[57] ABSTRACT

The present invention relates to fiber treatment compositions comprising an unsaturated acetate, an organohydrogensiloxane, a metal catalyst, an organosilicon compound, and optionally a dispersant. The compositions of the present invention impart beneficial characteristics such as slickness, softness, compression resistance and water repellency to substrates such as fibers and fabrics.

28 Claims, No Drawings

FIBER TREATMENT COMPOSITIONS CONTAINING ORGANOFUNCTIONAL SILOXANES AND METHODS FOR THE PREPARATION THEREOF

BACKGROUND OF THE INVENTION

The present invention relates to a fiber treatment compositions and to a method of making fiber treatment compositions. More particularly, the present invention relates to organofunctional silicone emulsions and their ability to impart beneficial characteristics such as slickness, softness, compression resistance and water repellency to substrates such as fibers and fabrics that is not possible without the use of the compositions and method of the instant invention.

It is generally known to treat textile fibers with organopolysiloxanes to impart a variety of valuable properties to the fibers, such as water repellency, softness, lubricity, antipilling, good laundry and dry cleaning durability, and the like. The use of organopolysiloxanes to achieve such properties is now well established but there continues to be a need to improve these and other desirable properties of the fibers, especially the antipilling properties of the fabrics made from treated fibers. In particular, there has existed a desire to improve the properties of the fibers while improving the processes by which the organopolysiloxane compositions are applied to the fibers, and in this regard, the need to speed up the processing of the fibers is the most urgently needed.

Typical of prior art compositions and processes used for achieving the desirable processing and end use properties are those curable compositions disclosed in U.S. Pat. No. 3,876,459, issued Apr. 8, 1975 to Burrill in which there is set forth compositions obtained by mixing polydiorganosiloxanes having terminal silicon-bonded hydroxyl radicals with an organosilane (or partial hydrolysates thereof) of the formula RSiR'n(X)3-n, in which R is a monovalent radical containing at least two amine groups, R' is an alkyl or aryl group, X is an alkoxy radical and n is 0 or 1.

The polydiorganosiloxanes are linear or substantially linear siloxane polymers having terminal silicon-bonded hydroxyl radicals and an average degree of substitution on silicon of 1.9 to 2.0 wherein the substituents are generally methyl radicals. The siloxane polymers have an average molecular weight of at least 750 with the preferred moleculār weight being in the range of 20,000 to 90,000. The cure mechanism appears to arise through the reaction of the hydrolyzable groups on the silane with the silanol groups of the siloxane polymer, usually under the influence of a catalyst, and at elevated temperatures.

Burrill discloses in U.S. Pat. No. 4,177,176, issued Dec. 4, 1979, an additional composition for use in treating fibrous materials. The composition is disclosed as containing a polydiorganosiloxane having a molecular weight of at least 2500 and terminal —OX groups in which X is hydrogen, lower alkyl or alkoxyalkyl groups with the proviso that there also be present at least two substituents in the polydiorganosiloxanes which are amine groups. There is also present an organosiloxane having at least three silicon-bonded hydrogen atoms, the curing mechanism being based on the reaction of the silicon-bonded hydrogen atoms with the silanol end blocks of the polydiorganosiloxane polymers under the influence of a catalyst.

Also included in the prior art is the disclosure of Burrill, et al. in U.S. Pat. No. 4,098,701, issued Jul. 4, 1978 in which the inventors set forth yet; another curable polysiloxane composition which has been found useful for treating fibers which comprises a polydiorganosiloxane in which at least two siliconbonded substituents contain at least two amino groups, a siloxane having silicon-bonded hydrogen atoms, and a siloxane curing catalyst. A study of the '701 patent shows that "siloxane curing catalyst" is used in the sense that non-siloxane containing organofunctional compounds are used to cure siloxane curable materials, and that siloxane compositions that function as catalysts is not intended.

Also, there is disclosed in the prior art the curable system described by Spyropolous et al, in European patent application publication 0 358 329 wherein microemulsions are described in which the oil phase comprises a reaction product of an organosilicon compound having amino groups and an organosilicon compound having epoxy groups, wherein the reaction product has at least one amino group and two silicon-bonded —OR groups, and a method for making the microemulsions. The organosilicon compound having at least one silicon-bonded substituent of the general formula —R'NHR", wherein R' is a divalent hydrocarbon group having up to 8 carbon atoms, and R" denotes hydrogen, an alkyl group or a group of the general formula —RBH2, and (B) an organosilicon compound having at least one substituent of the general formula —R'—Y, wherein R' is as defined for those above, and Y denotes an epoxy group containing moiety, whereby the molar ratio of amino groups in (A) to epoxy groups (B) is greater than 1/1, there being present in the reaction product at least two silicon-bonded —OR groups, wherein R denotes an alkyl,, aryl, alkoxyalkyl, alkoxyaryl or aryloxyalkyl groups having up to 8 carbon atoms.

Chen et al., in U.S. Pat. No. 5,063,260 discloses curable silicone compositions which impart beneficial characteristics to fibers, the compositions comprising an amino organofunctional substantially linear polydiorganosiloxane polymer, a blend of an epoxy organofunctional substantially linear polydiorganosiloxane polymer and a carboxylic acid organofunctional substantially linear polydiorganosiloxane polymer, and an aminoorganosilane. Chen et al. also discloses a process for the treatment of animal, cellulosic, and synthetic fibers by applying the composition described above the fiber and thereafter curing the composition on the fiber to obtain a treated fiber.

Yang in European Patent Application No. 0415254 discloses stable aqueous emulsion compositions containing an aminofunctional polyorganosiloxane containing at least two amino functionalized groups per molecule, one or more silanes and optionally a hydroxy terminated polydiorganosiloxane, textiles treated with the emulsion compositions, and processes for the preparation of the emulsion compositions. Revis in U.S. Pat. Nos. 4,954,401, 4,954,597, and 5,082,735 discloses a coating for a paper substrate produced by contacting and forming a mixture of an allyl ester with at least one methylhydrogensiloxane in the presence of a Group VIII metal catalyst, coating the mixture on the substrate, and heating the mixture of the allyl ester, the methylhydrogensiloxane, the substrate, and the Group VIII metal catalyst in the presence of ambient moisture until the methylhydrogensiloxane becomes cured and cross-linked.

Bunge in U.S. Pat. No. 4,954,554 discloses aqueous emulsions compositions consisting essentially of a curable silicone composition comprising organopolysiloxane having silicon-bonded hydroxyl radicals or silicon-bonded olefinic radicals, an organohydrogenpolysiloxane and a curing catalyst, a polyvinylalcohol emulsifyingagent having a degree of hydrolysis of 90 mole percent or more, and water. These compositions are disclosed as having improved gloss and/or water-repellency and/or adhesive release.

Other silicone emulsions containing olefinic siloxanes have been disclosed. For example, Hara et al. in U.S. Pat. Nos. 5,095,067 and 5,104,927 teaches a release silicone emulsion composition comprising 100 parts by weight of a specific organovinylpolysiloxane, from 1 to 50 parts by weight of a specific organohydrogensiloxane, from 0.5 to 5 parts of a platinum catalyst having a viscosity of 10 centistokes or less at 25° C., from 1.5 to 15 parts by weight of a nonionic emulsifying agent having an average HLB of from 10 to 20, and a Ph of 6.5 or less, and water. These compositions are disclosed as having good pot life, curability and that the cured film has good release properties and residual adhesive properties of adhesives.

However, none of the references hereinabove disclose a one component fiber treating emulsion comprising an unsaturated acetate, at least one organohydrogensiloxane, a metal catalyst, an organosilicon compound, and one or more surfactants or solvents which imparts beneficial characteristics to textile fibers.

SUMMARY OF THE INVENTION

The instant invention relates to compositions and to improved methods for their use to treat substrates such as fibers and fabrics to enhance the characteristics of the substrates. More specifically, the present invention relates to a fiber treatment composition comprising: (A) an unsaturated acetate; (B) an organohydrogensiloxane; (C) a metal catalyst; and (D) an organosilicon compound.

It has been discovered that a heat activated crosslinking composition consisting of a blend of an unsaturated acetate, an organohydrogensiloxane, a metal catalyst, and an organosilicon compound can be used for the treatments of fibers and fabrics to impart slickness, softness, compression resistance and water repellency to the substrates. The composition remains a fluid until an activation temperature is reached at which point cross-linking occurs.

The present invention further relates to a method of treating a substrate, the method comprising the steps of (I) mixing: (A) an unsaturated acetate, (B) at least one organohydrogensiloxane, (C) a metal catalyst, and (D) an organosilicon compound, and (E) a dispersant selected from the group consisting one or more surfactants and one or more solvents to the mixture of (I), (II) applying the mixture from (I) to a substrate, and (III) heating the substrate.

The present invention also relates to a method of making a fiber treatment composition comprising (I) mixing (i) an organosilicon compound and (ii) a dispersant selected from the group consisting one or more surfactants and one or more solvents, (II) adding to the mixture of (I) a mixture of: (iii) an unsaturated acetate, (iv) at least one organohydrogensiloxane, and (v) a metal catalyst.

It is an object of this invention to provide a fiber treatment composition which imparts slickness, softness, compression resistance, and water repellency to fibers and fabrics.

It is also an object of this invention to provide a fiber treatment composition as a one component stable emulsion composition. It is an additional object of this invention to provide a fiber treatment composition which is non-toxic.

It is an additional object of this invention to provide a fiber treatment composition which has a low cure temperature.

These and other features, objects and advantages of the present invention will be apparent upon consideration of the following detailed description of the invention.

DETAILED DESCRIPTION OF THE INVENTION

The present invention relates to a fiber treatment composition comprising: (A) an unsaturated acetate; (B) an organohydrogensiloxane; (C) a metal catalyst; and (D) an organosilicon compound.

Component (A) in the fiber treatment compositions of the instant invention is an unsaturated acetate. The unsaturated acetate can be an allyl ester or vinyl ester such as allyl butyrate, allyl acetate, linallyl acetate, allyl methacrylate, vinyl acetate, allyl acrylate, vinyl butyrate, isopropenyl acetate, vinyl trifluoroacetate, 2-methyl-l-butenyl acetate, vinyl 2-ethyl hexanoate, vinyl 3,5,5-trimethylhexanoate, allyl 3-butenoate, bis-(2-methylallyl)carbonate, diallyl succinate, ethyl diallylcarbamate, and other known allyl esters. It is preferred for the compositions of the instant invention that the unsaturated acetate is selected from the group consisting of allyl acetate, linallyl acetate, and isopropenyl acetate.

The amount of Component (A) employed in the compositions of the present invention varies depending on the amount of organohydrogensiloxane, metal catalyst, and organosilicon compound that is employed. It is preferred for purposes of this invention that from 0.1 to 50 weight percent of (A), the unsaturated acetate, be used, and it is highly preferred that from 2 to 10 weight percent of unsaturated acetate be employed, said weight percent being based on the total weight of the composition.

Component (B) in the compositions of the present invention is at least one organohydrogensilicon compound which is free of aliphatic unsaturation and contains two or more silicon atoms linked by divalent radicals, an average of from one to two silicon-bonded monovalent radicals per silicon atom and an average of at least one, and preferably two, three or more silicon-bonded hydrogen atoms per molecule thereof. Preferably the organohydrogensiloxane in the compositions of the present invention contains an average of three or more silicon-bonded hydrogen atoms such as, for example, 5, 10, 20, 40, 70, 100, and more.

The organohydrogenpolysiloxane is preferably a compound having the average unit formula $R_a^1H_bSiO_{(4-a-b)/2}$ wherein $R^1$ denotes said monovalent radical free of aliphatic unsaturation, the subscript b has a value of from greater than 0 to 1, such as 0.001, 0.01, 0.1 and 1.0, and the sum of the subscripts a plus b has a value of from 1 to 3, such as 1.2, 1.9 and 2.5. Siloxane units in the organohydrogenpolysiloxanes having the average unit formula immediately above have the formulae $R_3^3SiO_{\frac{1}{2}}$, $R_2^3HSiO_{\frac{1}{2}}$, $R_2^3SiO_{2/2}$, $R^3HSiO_{2/2}$, $R^3SiO_{3/2}$, $HSiO_{3/2}$ and $SiO_{4/2}$. Said siloxane units can be combined in any molecular arrangement such as linear, branched, cyclic and combinations thereof, to provide organohydrogenpolysiloxanes that are useful as component (B) in the compositions of the present invention.

A preferred organohydrogenpolysiloxane for the compositions of this invention is a substantially linear organohydrogenpolysiloxane having the formula $XR_2SiO(XRSiO)_cSiR_2X$ wherein each R denotes a monovalent hydrocarbon or halohydrocarbon radical free of aliphatic unsaturation and having from 1 to 20 carbon atoms. Monovalent hydrocarbon radicals include alkyl radicals, such as methyl, ethyl, propyl, butyl, hexyl, and octyl; cycloaliphatic radicals, such as cyclohexyl; aryl radicals, such as phenyl, tolyl, and xylyl; aralkyl radicals, such as benzyl and phenylethyl. Highly preferred monovalent hydrocarbon radical for the silicon-containing components of this invention are methyl and phenyl. Monovalent halohydrocarbon radicals free of aliphatic unsaturation include any monovalent hydrocarbon radical noted above which is free of aliphatic unsaturation and has at least one of its hydrogen atoms replaced with a halogen, such as fluorine, chlorine, or bromine. Preferred monovalent halohydrocarbon radicals have the formula $C_nF_{2n+1}CH_2CH_2$— wherein the subscript n has a value of from 1 to 10, such as, for example, $CF_3CH_2CH_2$— and $C_4F_9CH_2CH_2$—. The several R radicals can be identical or different, as desired. Additionally, each X denotes a hydrogen atom or an R radical. Of course, at least two X radicals must be hydrogen atoms. The exact value of y depends upon the number and identity of the R radicals; however, for organohydrogenpolysiloxanes containing only methyl radicals as R radicals c will have a value of from about 0 to about 1000.

In terms of preferred monovalent hydrocarbon radicals, examples of organopolysiloxanes of the above formulae which are suitable as the organohydrogensiloxane for the compositions of this invention include $HMe_2SiO(Me_2SiO)_cSiMe_2H$, $(HMe_2SiO)_4Si$, cyclo$(MeHSiO)_c$, $(CF_3CH_2CH_2)MeHSiO\{Me(CF_3CH_2CH_2)SiO\}_cSiHMe(CH_2CH_2CF_3)$, $Me_3SiO(MeHSiO)_cSiMe_3$, $HMe_2SiO(Me_2SiO)_{0.5c}(MeHSiO)_{0.5c}SiMe_2H$, $HMe_2SiO(Me_2SiO)_{0.5c}(MePhSiO)_{0.1c}(MeHSiO)_{0.4c}SiMe_2H$, $Me_3SiO(Me_2SiO)_{0.3c}(MeHSiO)_{0.7c}SiMe_3$ and $MeHSi(OSiMe_2H)_3$ organohydrogenpolysiloxanes that are useful as Component (B).

Highly preferred linear organohydrogenpolysiloxanes for the compositions of this invention have the formula $YMe_2SiO(Me_2SiO)_p(MeYSiO)_qSiMe_2Y$ wherein Y denotes a hydrogen atom or a methyl radical. An average of at least two Y radicals per molecule must be hydrogen atoms. The subscripts p and q can have average values of zero or more and the sum of p plus q has a value equal to c, noted above. The disclosure of U.S. Pat. No. 4,154,714 shows highly-preferred organohydrogenpolysiloxanes.

Especially preferred as Component (B) are methylhydrogensiloxanes selected from the group consisting of bis(trimethylsiloxy)dimethyldihydrogendisiloxane, diphenyldimethyldisiloxane, diphenyltetrakis(dimethylsiloxy)disiloxane, heptamethylhydrogentrisiloxane, hexamethyldihydrogentrisiloxane, methylhydrogencyclosiloxanes, methyltris(dimethylhydrogensiloxy)silane, pentamethylpentahydrogencyclopentasiloxane, pentamethylhydrogendisiloxane, phenyltris(dimethylhydrogensiloxy)silane, polymethylhydrogensiloxane, tetrakis(dimethylhydrogensiloxy)silane, tetramethyltetrahydrogencyclotetrasiloxane, tetramethyldihydrogendisiloxane, and methylhydrogendimethylsiloxane copolymers.

The amount of Component (B) employed in the compositions of the present invention varies depending on the amount of unsaturated acetate, metal catalyst, and organosilicon compound that is employed. It is preferred for purposes of this invention that from 40 to 99.9 weight percent of Component (B) be used, and it is highly preferred that from 70 to 90 weight percent of Component (B) be employed, said weight percent being based on the total weight of the composition.

Component (C) in the compositions of the present invention is a metal catalyst. Preferred metal catalysts for the present invention are the Group VIII metal catalysts and complexes thereof. By Group VIII metal catalyst it is meant herein iron, cobalt, nickel, ruthenium, rhodium, palladium, osmium, iridium and platinum. The metal catalyst of Component (C) can be a platinum containing catalyst component since they are the most widely used and available. Platinum-containing catalysts can be platinum metal, optionally deposited on a carrier, such as silica gel or powdered charcoal; or a compound or complex of a platinum group metal. A preferred platinum-containing catalyst component in the compositions of this invention is a form of chloroplatinic acid, either as the commonly available hexahydrate form or as the anhydrous form, as taught by Speier, U.S. Pat. No. 2,823,218, incorporated herein by reference. A particularly useful form of chloroplatinic acid is that composition obtained when it is reacted with an aliphatically unsaturated organosilicon compound such as divinyltetramethyldisiloxane, as disclosed by Willing, U.S. Pat. No. 3,419,593, incorporated herein by reference, because of its easy dispersibility in organosilicon systems. Other platinum catalysts which are useful in the present invention include those disclosed in U.S. Pat. Nos. 3,159,601; 3,159,602; 3,220,972; 3,296,291; 3,516,946; 3,814,730 and 3,928,629, incorporated herein by reference. The preferred Group VIII metal catalyst as Component (C) for the compositions of the present invention is $RhCl_3$, $RhBr_3$, $RhI_3$, and complexes thereof, although as described hereinabove other appropriate catalyst systems may be employed such as $ClRh(PPh_3)_3$ and complexes thereof; $H_2PtCl_6$; a complex of 1,3-divinyl tetramethyl disiloxane and $H_2PtCl_6$; and alkyne complexes of $H_2PtCl_6$. A more exhaustive list of appropriate catalyst systems which can be employed as Component (C) in the present invention is set forth in U.S. Pat. No. 4,746,750, which is considered incorporated herein by reference. The Group VII metal catalyst may be complexed with a solvent such as THF (tetrahydrofuran).

Also suitable as a catalyst for Component (C) in the compositions of the instant invention are the novel rhodium catalyst complexes disclosed in copending U.S. application for patent, Ser. No. 08/176,168, filing date Dec. 30, 1993, and assigned to the same assignee as this present application, incorporated herein by reference. These novel rhodium catalyst complexes are generally compositions comprising a rhodium catalyst, an unsaturated acetate such as linallyl acetate, and alcohols having having 3 or more carbon atoms including diols, furans having at least one OH group per molecule, and pyrans having at least one OH group per molecule.

The amount of Group VIII metal catalyst, Component (C), that are used in the compositions of this invention is not narrowly limited and can be readily determined by one skilled in the art by routine experimentation. However, the most effective concentration of the Group VIII metal catalyst has been found to be from about one part per million to about two thousand parts per million on a weight basis relative to the unsaturated acetate of Component (A).

Also suitable for use as the metal catalyst Component (C) in the compositions of the instant invention are encapsulated metal catalysts. The encapsulated metal catalyst can be a microencapsulated liquid or solubilized curing catalyst which are prepared by the photoinitiated polymerization of at least one solubilized hydroxyl-containing ethylenically unsaturated organic compound in the presence of a photoinitiator for the polymerization of said compound, an optional surfactant, and a liquid or solubilized curing catalyst for organosiloxane compositions such as the catalysts described by Lee et al. in U.S. Pat. Nos. 5,066,699 and 5,077,249 which are considered incorporated herein by reference. It is preferred for purposes of the present invention that the encapsulated metal catalyst is a microencapsulated curing catalyst prepared by irradiating with UV light in the wavelength range of from 300 to 400 nanometers a solution containing (1) at least one of a specified group of photocrosslinkable organosiloxane compounds derived from propargyl esters of carboxylic acids containing a terminal aromatic hydrocarbon radical and at least two ethylenically unsaturated carbon atoms and (2) a liquid or solubilized hydrosilylation catalyst, such as the catalysts described by Evans et al. in U.S. Pat. No. 5,194,460 and in copending U.S. application for patent, Ser. No. 08/001,607, filing date Jan. 7, 1993, and assigned to the same assignee as this present application, now U.S. Pat. No. 5,279,898, which are considered incorporated herein by reference.

The amount of microencapsulated curing catalyst in the fiber treatment compositions of this invention are typically not restricted as long as there is a sufficient amount to accelerate a curing reaction between components (A) and (B). Because of the small particle size of microencapsulated curing catalysts it is possible to use curing catalyst concentrations equivalent to as little as 1 weight percent or less to as much as 10 weight percent of microencapsulated curing catalyst as Component (C) in the compositions of the present invention, said weight percent being based on the total weight of the composition.

Component (D) in the compositions of this invention is an organosilicon compound having an average of at least one group per molecule selected from the group consisting of hydroxy groups, carboxy groups, ester groups, amino groups, acetoxy groups, sulfo groups, alkoxy groups, acrylate groups, epoxy groups, fluoro groups, ether groups, olefinic hydrocarbon or halohydrocarbon radicals having from 2 to 20 carbon atoms, and mixtures thereof. It is preferred for purposes of the present invention that Component (D) is a compound having its formula selected from the group consisting of (i) $R^1_3SiO(R_2SiO)_x(R^1RSiO)_ySiR^1_3$, (ii) $R_2R^1SiO(R_2SiO)_x(R^1RSiO)_ySiR_2R^1$, (iii) $RR^1_2SiO(R_2SiO)_x(R^1RSiO)_ySiRR^1_2$, wherein R is a monovalent hydrocarbon or halohydrocarbon radical having from 1 to 20 carbon atoms, $R^1$ is a group selected from the group consisting of hydroxy groups, carboxy groups, ester groups, amino groups, acetoxy groups, sulfo groups, alkoxy groups, acrylate groups, epoxy groups, fluoro groups, ether groups, olefinic hydrocarbon or halohydrocarbon radicals having from 2 to 20 carbon atoms, and mixtures thereof, x has a value of 0 to 3000, and y has a value of 1 to 100.

The monovalent radicals of R in Component (D) can contain up to 20 carbon atoms and include halohydrocarbon radicals free of aliphatic unsaturation and hydrocarbon radicals. Monovalent hydrocarbon radicals include alkyl radicals, such as methyl, ethyl, propyl, butyl, hexyl, and octyl; cycloaliphatic radicals, such as cyclohexyl; aryl radicals, such as phenyl, tolyl, and xylyl; aralkyl radicals, such as benzyl and phenylethyl. Highly preferred monovalent hydrocarbon radical for the silicon-containing components of this invention are methyl and phenyl. Monovalent halohydrocarbon radicals include any monovalent hydrocarbon radical noted above which has at least one of its hydrogen atoms replaced with a halogen, such as fluorine, chlorine, or bromine. Preferred monovalent halohydrocarbon radicals have the formula $C_nF_{2n+1}CH_2CH_2$— wherein the subscript n has a value of from 1 to 10, such as, for example, $CF_3CH_2CH_2$— and $C_4F_9CH_2CH_2$—. The several R radicals can be identical or different, as desired and preferably at least 50 percent of all R radicals are methyl.

The functional groups of $R^1$ are selected from the group consisting of hydroxy groups, carboxy groups, ester groups, amino groups, acetoxy groups, sulfo groups, alkoxy groups, acrylate groups, epoxy groups, fluoro groups, ether groups, olefinic hydrocarbon or halohydrocarbon radicals having from 2 to 20 carbon atoms, and mixtures thereof. Hydroxy groups suitable for use in the compositions of the instant invention include hydroxyalkyl groups, hydroxyaryl groups, hydroxycycloalkyl groups, and hydroxycycloaryl groups. Preferred hydroxy (OH) groups as $R^1$ in the compositions of this invention include groups such as hydroxy, hydroxypropyl, hydroxybutyl, hydroxyphenyl, hydroxymethylphenyl, hydroxyethylphenyl, and hydroxycyclohexyl.

Carboxy groups suitable for use as $R^1$ in the compositions of the instant invention include carboxyalkyl groups, carboxyaryl groups, carboxycycloalkyl groups, and carboxycycloaryl groups. Preferred carboxy groups as $R^1$ in the compositions of this invention include groups such as carboxy, carboxymethyl, carboxyethyl, carboxypropyl, carboxybutyl, carboxyphenyl, carboxymethylphenyl, carboxyethylphenyl, and carboxycyclohexyl.

Ester groups can, also be used as $R^1$ in the formulae hereinabove. These ester groups can include groups such as alkylesters, arylesters, cycloalkylesters, and cycloarylesters. Preferred ester groups suitable as $R^1$ in the instant invention are selected from the group consisting of ethyl acetate, methyl acetate, n-propyl acetate, n-butyl acetate, phenyl acetate, benzyl acetate, isobutyl benzoate, ethyl benzoate, ethyl propionate, ethyl stearate, ethyl trimethylacetate, methyl laurate, and ethyl palmitate.

Preferred amino groups as $R^1$ in the compositions of this invention are exemplified by groups having the formula $NR_2$ wherein R is hydrogen or a monovalent hydrocarbon radical having from 1 to 20 carbon atoms such as aminoalkyl groups, aminoaryl groups, aminocycloalkyl groups, and aminocycloaryl groups. Preferred as amino groups in the instant invention are groups such as amino, aminopropyl, ethylene diaminopropyl, aminophenyl, aminooctadecyl, aminocyclohexyl, propylene diaminopropyl, dimethylamino, and diethylamino.

Acetoxy groups suitable as $R^1$ in the compositions of the present invention are exemplified by groups having the formula —$COOCH_3$ such as acetoxyalkyl groups, acetoxyaryl groups, acetoxycycloalkyl groups, and acetoxycycloaryl groups. Preferred acetoxy groups in the compositions of the instant invention include acetoxy, acetoxyethyl, acetoxypropyl, acetoxybutyl, acetoxyphenyl, and acetoxycyclohexyl.

Sulfo groups which are preferred as $R^1$ in the compositions of the present invention are exemplified by groups having the formula SR wherein R is hydrogen or a monovalent hydrocarbon radical having from 1 to 20 carbon atoms such as sulfoalkyl groups, sulfoaryl groups, sulfocycloalkyl groups, and sulfocycloaryl groups. Preferred sulfo groups include hydrogen sulfide, sulfopropyl, methylsulfopropyl, sulfophenyl, and methylsulfo.

Fluoro groups are exemplified by groups such as fluoroalkyl groups, fluoroaryl groups, fluorocycloalkyl groups, and fluorocycloaryl groups. Preferred fluoro groups which are suitable as $R^1$ in the compositions of this invention include fluoro, fluoropropyl, fluorobutyl, 3,3,3-trifluoropropyl, and 3,3,4,4,5,5,6,6,6-nonafluorohexyl.

Alkoxy groups suitable as $R^1$ in component (D) of this invention include groups such as alkoxyalkyl groups, alkoxyaryl groups, alkoxycycloalkyl groups, and alkoxycycloaryl groups. Preferred alkoxy groups for $R^1$ in the present invention are groups such as methoxy, ethoxy, butoxy, tertiary-butoxy, propoxy, isopropoxy, methoxyphenyl, ethoxyphenyl, methoxybutyl, and methoxypropyl groups.

Epoxy groups suitable as $R^1$ in component (D) of this invention include groups such as epoxyalkyl groups, epoxyaryl groups, epoxycycloalkyl groups, and epoxycycloaryl groups. Preferred epoxy groups for $R^1$ in the present invention are groups such as epoxide, epichlorohydrin, ethylene oxide, epoxybutane, epoxycyclohexane, epoxy ethylhexanol, epoxy propanol, and epoxy resin groups.

Acrylate groups suitable as $R^1$ in the formulae hereinabove include groups such as acryloxy, acryloxyalkyl groups, acryloxyaryl groups, acryloxycycloalkyl groups, and acryloxycycloaryl groups. Preferred acrylate groups suitable as $R^1$ in the instant invention are selected from the group consisting of acryloxyethyl, acryloxyethoxy, acryloxypropyl, acryloxypropoxy, methacryloxyethyl, methacryloxyethoxy, methacryloxypropyl, and methacryloxypropoxy.

Ether groups can also be used as $R^1$ in the formulae hereinabove. These ether groups can include groups such as alkylethers, arylethers, cycloalkylethers, and cycloarylethers. Preferred ether groups suitable as $R^1$ in the instant invention are selected from the group consisting of methylethylether, methylpropylether, ethylmethylether, ethylethylether, ethylpropylether, methylphenylether, ethylphenylether, isopropylphenylether, tertiary-butylpropylether, methylcyclohexylether, and ethylcyclohexylether.

The olefinic hydrocarbon radicals of $R^1$ of the present invention may have from 2 to 20 carbon atoms. The olefinic hydrocarbon radicals are preferably selected from the group consisting of the vinyl radical and higher alkenyl radicals represented by the formula —$R(CH_2)_mCH{=}CH_2$ wherein R denotes —$(CH_2)_n$— or —$(CH_2)_pCH{=}CH$— and m has the value of 1, 2, or 3, n has the value of 3 or 6, and p has the value of 3, 4, or 5. The higher alkenyl radicals represented by the formula —$R(CH_2)_mCH{=}CH_2$ contain at least 6 carbon atoms. For example, when R denotes —$(CH_2)_n$—, the higher alkenyl radicals include 5-hexenyl, 6- heptenyl, 7-octenyl, 8-nonenyl, 9-decenyl, and 10-undecenyl. When R denotes —$(CH_2)_pCH{=}CH$—, the higher alkenyl radicals include, among others, 4,7-octadienyl, 5,8-nonadienyl, 5,9-decadienyl, 6,11-dodecadienyl and 4,8-nonadienyl. Alkenyl radicals selected from the group consisting of 5-hexenyl, 7-octenyl, 9-decenyl, and 5,9-decadienyl, are preferred. It is more preferred that R denote —$(CH_2)_n$— so that the radicals contain only terminal unsaturation and the most preferred radicals are the vinyl radical and the 5-hexenyl radical.

Specific examples of preferred polydiorganosiloxanes for use as Component (D) in the compositions of the present invention include $ViMe_2SiO(Me_2SiO)_x$-$SiMe_2Vi$, $HexMe_2SiO(Me_2SiO)_x(MeHexSiO)_ySiMe_2$-Hex, $ViMe_2SiO(Me_2SiO)_x(MeViSiO)_ySiMe_2Vi$, Hex-$Me_2SiO(Me_2SiO)_{196}(MeHexSiO)_4SiMe_2Hex$, $HexMe_2$-$SiO(Me_2SiO)_{198}(MeHexSiO)_2SiMe_2Hex$, $HexMe_2SiO$(-$Me_2SiO)_{151}(MeHexSiO)_3SiMe_2Hex$, and $ViMe_2SiO$(-$Me_2SiO)_{96}(MeViSiO)_2SiMe_2Vi$, $HexMe_2SiO(Me_2Si$-$O)_xSiMe_2Hex$, $PhMeViSiO\ (Me_2SiO)_xSiPhMeVi$, Hex-$Me_2SiO(Me_2SiO)_{130}SiMe_2Hex$, $ViMePhSiO\ (Me_2Si$-$O)_{145}SiPhMeVi$, $ViMe_2SiO(Me_2SiO)_{299}SiMe_2Vi$, $ViMe_2SiO(Me_2SiO)_{800}SiMe_2Vi$, $ViMe_2SiO(Me_2SiO)_{30}$-$_0SiMe_2Vi$, $ViMe_2SiO(Me_2SiO)_{198}SiMe_2Vi$, vinyldimethylsiloxy-terminated poly((3,3,3 -trifluoropropyl)methylsiloxy)pentasiloxane, vinylmethylsiloxy-terminated polydimethylsiloxane having (3,3,4,4,5,5,6,6,6-nonafluorobutyl)methylsiloxy functional groups. vinyldimethylsiloxy-terminated polydimethyldodecasiloxane having (3,3,3-trifluoropropyl)methysiloxy groups, vinylmethylsiloxy-terminated polydimethylsiloxane having (3,3,4,4,5,5,6,6,6-nonafluorobutyl)methylsiloxy functional groups, dimethylhydridosiloxy-terminated poly((3,3,3trifluoropropyl)methylsiloxy)pentasiloxane, dimethylhydroxysiloxy-terminated polydimethylsiloxane, and dimethylhydroxysiloxy-terminated dimethyl-(aminoethylaminopropyl)methyl siloxane, wherein Me, Vi, Hex, and Ph denote methyl, vinyl, 5-hexenyl and phenyl, respectively.

The amount of Component (D) employed in the compositions of the present invention varies depending on the amount of organohydrogensiloxane, metal catalyst, and unsaturated acetate, that is employed. It is preferred for purposes of this invention that from 1 to 99 weight percent of (D), the organosilicon compound, be used, and it is highly preferred that from 70 to 95 weight percent of (D) be employed, said weight percent being based on the total weight of the composition.

The compositions of the instant invention can further comprise (E) a dispersant selected from the group consisting of one or more surfactants and one or more solvents. The (emulsifying agents) surfactants are preferably of the non-ionic or cationic types and may be employed separately or in combinations of two or more. Suitable emulsifying agents for the preparation of a stable aqueous emulsion are known in the art. Examples of nonionic surfactants suitable as component (E) of the present invention include polyoxyethylene alkyl ethers, polyoxyethylene alkylphenol ethers, polyoxyethylene lauryl ethers and polyoxyethylene sorbitan monoleates such as Brij TM 35L (from ICI Americas Inc., Wilmington, Del. 19897), Brij TM 30 (ICI Americas Inc., Wilmington, Del. 19897), and Tween TM 80 (ICI Americas Inc., Wilmington, Del. 19897), polyoxyethylene alkyl esters, polyoxyethylene sorbitan alkyl esters, polyethylene glycol, polypropylene glycol, ethoxylated trimethylnonanols such as Tergitol® TMN-6 (from Union Carbide Chem. & Plastics Co., Industrial Chemicals Div., Danbury, Conn. 06817-0001), and polyoxyalkylene glycol modified polysiloxane surfactants. Examples of cationic surfactants suitable as component (E) in the compositions of the instant invention include quaternary ammonium salts such as alkyltrimethylammonium hydroxide, dialkyldimethylammonium hydroxide, methylpolyoxyethylene cocoammonium chloride, and diplmityl hydroxyethylammonium methosulfate. Preferably, a combination of two or three nonionic surfactants, or a combination of a cationic surfactant and one or two nonionic surfactants are used to prepare the emulsions of the present invention.

Examples of the preferred surfactants for use as Component (E) in the compositions of this invention are the reaction products of alcohols and phenols with ethylene oxide such as the polyethoxyethers of nonyl phenol and octyl phenol and the trimethylnol ethers of polyethylene glycols, monoesters of alcohols and fatty acids such as glycerol monostearate and sorbitan monolaurate, and the ethoxylated amines such as those represented by the general formula

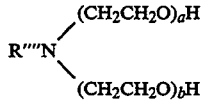

in which R'''' is an alkyl group having from about 12 to about 18 carbon atoms and the sum of a and b is from 2 to about 15. Silicone surfactants are also suitable for use as Component (E) in the instant invention. Preferred silicone surfactants include silicone polyethers such as polyalkylpolyether siloxanes and silicone glycol surfactants including silicone glycol polymers and copolymers such as those disclosed in U.S. Pat. No. 4,933,002, incorporated herein by reference. The emulsifying agents may be employed in proportions conventional for the emulsification of siloxanes, from about 1 to about 30 weight percent, based on the total weight of the composition.

Solvents may also be employed as Component (E) in the compositions of the instant invention. Preferred solvents for use as Component (E) in the instant invention include hydrocarbon solvents such as dichloromethane (methylene chloride) and acetonitrile. It is preferred for purposes of the present invention that Component (E), the dispersant, be a mixture of water and one or more of the surfactants described hereinabove. It is also preferred that emulsification of the compositions of the instant invention is carried out by adding one or more emulsifying agents, and water be added to components (A), (B), (C), and (D) described hereinabove and the resulting composition be subjected to high shear.

The amount of Component (E) employed in the compositions of the present invention varies depending on the amount of organohydrogensiloxane, metal catalyst, unsaturated acetate, and organosilicon compound that is employed. It is preferred for purposes of this invention that from 0.25 to 99 weight percent of (E), the dispersant, be used, and it is highly preferred that from 1 to 95 weight percent of dispersant be employed, said weight percent being based on the total weight of the composition. When a surfactant is employed it is preferred that from 0.25 to 20 weight percent be used, and when a solvent is employed it is preferred that from 70 to 99.5 weight percent be used, said weight percent being based on the total weight of the composition.

The present invention further relates to a method of treating a substrate, the method comprising the steps of (I) mixing: (A) an unsaturated acetate, (B) at least one organohydrogensiloxane, (C) a metal catalyst, (D) an organosilicon compound having an average of at least one group per molecule selected from the group consisting of hydroxy groups, carboxy groups, ester groups, amino groups, acetoxy groups, sulfo groups, alkoxy groups, acrylate groups, epoxy groups, fluoro groups, ether groups, olefinic hydrocarbon or halohydrocarbon radicals having from 2 to 20 carbon atoms, and mixtures thereof, and (E) a dispersant selected from the group consisting of one or more surfactants and one or more solvents, (II) applying the mixture from (I) to a substrate, and (III) heating the substrate. Components (A), (B), (C), (D), and (E) are as delineated above including preferred amounts and embodiments thereof.

The present invention also relates to a method of making a fiber treatment composition comprising (I) mixing (A) an unsaturated acetate, (B) at least one organohydrogensiloxane, (C) a metal catalyst, (D) an organosilicon compound having an average of at least one group per molecule selected from the group consisting of hydroxy groups, carboxy groups, ester groups, amino groups, acetoxy groups, sulfo groups, alkoxy groups, acrylate groups, epoxy groups, fluoro groups, ether groups, olefinic hydrocarbon or halohydrocarbon radicals having from 2 to 20 carbon atoms, and mixtures thereof, and (E) a dispersant selected from the group consisting of one or more surfactants and one or more solvents. Again, Components (A), (B), (C), (D), and (E) are as delineated above including preferred amounts and embodiments thereof.

The present invention further relates to a method of making a fiber treatment composition comprising: (I) mixing: (i) an organosilicon compound having an average of at least one group per molecule selected from the group consisting of hydroxy groups, carboxy groups, ester groups, amino groups, acetoxy groups, sulfo groups, alkoxy groups, acrylate groups, epoxy groups, fluoro groups, ether groups, olefinic hydrocarbon or halohydrocarbon radicals having from 2 to 20 carbon atoms, and mixtures thereof, and (ii) a dispersant selected from the group consisting of one or more surfactants and one or more solvents; (II) adding to the mixture of (I) a mixture of: (iii) an unsaturated acetate, (iv) at least one organohydrogensiloxane, and (v) a metal catalyst. The mixture of Step (II) can be emulsified prior to adding the mixture of (II) to the mixture of (I) . Again, Components (A), (B), (C), (D), and the surfactants are as delineated above including preferred amounts and embodiments thereof.

The compositions comprising components (A), (B), (C), (D), and optionally any surfactants or solvents (E) may be applied to the fibers by employing any suitable application technique, for example by padding or spraying, or from a bath. For purposes of this invention, the compositions can be applied from a solvent, but is preferred that the compositions be applied from an aqueous medium, for example, an aqueous emulsion. Thus, any organic solvent can be employed to prepare the solvent-based compositions, it being understood that those solvents that are easily volatilized at temperatures of from room temperatures to less than 100° C. are preferred, for example, such solvents may include methylene chloride, acetonitrile, toluene, xylene, white spirits, chlorinated hydrocarbons, and the like. The treating solutions can be prepared by merely mixing the components together with the solvent. The concentration of the treating solution will depend on the desired level of application of siloxane to the fiber, and on the method of application employed, but it is believed by the inventors herein that the most effective amount of the composition should be in the range such that the fiber (or fabric) picks up the silicone composition at about 0.05% to 10% on the weight of the fiber or fabric. According to the instant inventive method of treatment, the fibers usually in the form of tow, or knitted or woven fabrics, are immersed in an aqueous emulsion of the compositions whereby the composition becomes selectively deposited on the fibers. The deposition of the composition on the fibers may also be expedited by increasing the temperatures of the aqueous emulsion, temperatures in the range of from 20° to 60° C. being generally preferred.

Preparation of the aqueous emulsions can be carried out by any conventional technique. The compositions of this can be prepared by homogeneously mixing Components (A), (B), (C), and (D) and any optional components in any order. Thus it is possible to mix all components in one mixing step immediately prior to using the fiber treatment compositions of the present invention. Most preferably (A), (B), and (C) are emulsified and then (D) is emulsified and the two emulsions thereafter combined. The emulsions of the present invention may be macroemulsions or microemulsions and may also contain optional ingredients, for example antifreeze additives, preservatives, biocides, organic softeners, antistatic agents, dyes and flame retardants. Preferred preservatives include Kathon® LX (5-chloro-2-methyl-4-isothiazolin-3-one from Rohm and Haas, Philadelphia, Pa. 19106), Giv-gard® DXN (6-acetoxy-2,4-dimethyl-m-dioxane from Givaudan Corp., Clifton N.J. 07014), Tektamer® A.D. (from Calgon Corp., Pittsburgh, Pa. 152300), Nuosept® 91,95 (from Huls America, Inc., Piscataway, N.J. 08854), Germaben® (diazolidinyl urea and parabens from Sutton Laboratories, Chatham, N.J. 07928), Proxel® (from ICI Americas Inc., Wilmington, Del. 19897), methyl paraben, propyl paraben, sorbic acid, benzoic acid, and lauricidin.

Following the application of the siloxane composition to the substrate, the siloxane is then cured. Preferably, curing is expedited by exposing the treated fibers to elevated temperatures, preferably from 50° to 200° C.

The compositions of this invention can be employed for the treatment of substrates such as animal fibers such as wool, cellulosic fibers such as cotton, and synthetic fibers such as nylon, polyester and acrylic fibers, or blends of these materials, for example, polyester/cotton blends, and may also be used in the treatment of leather, paper, and gypsum board. The fibers may be treated in any form, for example as knitted and woven fabrics and as piece goods. They may also be treated as agglomerations of random fibers as in filling materials for pillows and the like such as fiberfil.

The composition of components (A), (B), (C), and (D) should be used at about 0.05 to 25 weight percent in the final bath for exhaust method applications, and about 5 gm/l to 80 gm/l in a padding method of application, and about 5 gm/l to 600 gm/l for a spraying application. The compositions employed in this process are particularly suitable for application to the fibers or fabrics from an aqueous carrier. The compositions can be made highly substantive to the fibers, that is they can be made to deposit selectively on such fibers when applied thereto as aqueous emulsions. Such a property renders the compositions particularly suited for aqueous batch treatment by an exhaustion procedure, such exhaustion procedures being known to those skilled in the art. The compositions of the instant invention are new and novel and provide a fast cure and wide cure temperature ranges for curing them on fibers or fabrics compared to the compositions of the prior art, having a temperature cure range of from 50° C. to 200° C. Further, the fibers have superior slickness and no oily feeling after cure. The compositions of the instant invention provide consistent performance, good bath life of more than 24 hours at 40° C., have good laundry and dry cleaning durability, and have very good suitability for application by spraying.

Fiber Slickness was tested by using a DuPont® unslickened fiberfil product, i.e. Hollofil® T-808, for the evaluation of slickness imparted by the application of the silicone emulsion of the present invention. A piece of Hollofil® T-808 is soaked in the diluted emulsion of interest and then passed through a roller to obtain 100% wet-pickup, i.e., the weight of the finished fiberfil is twice that of the unfinished fiberfil. After drying at room temperature, the finished sample is heated at 175° C. for 2–25 minutes. Thus prepared, the finished fiberfil usually contains approximately the same silicone level as that of the emulsion of interest.

The slickness of fiberfil is measured by staple pad friction which is determined from the force required to pull a certain weight over a fiberfil staple pad. The staple pad friction is defined as the ratio of the force over the applied weight. A 10 pound weight was used in the friction measurement of this invention. A typical instrument set-up includes a friction table which is mounted on the crosshead of an Instron tensile tester. The friction table and the base of the weight are covered with Emery Paper #320 from the 3M Company so that there is little relative movement between the staple pad and the weight or the table. Essentially all of the movement is a result of fibers sliding across each other. The weight is attached to a stainless steel wire which runs through a pulley mounted at the base of the Instron tester. The other end of the stainless steel wire is tied to the loadcell of the Instron tester.

Following are examples illustrating the compositions and methods of the present invention. In the examples hereinbelow, THF denotes tetrahydrofuran, THFA denotes tetrahydrofurfuryl alcohol, and TPRh denotes $(Ph_3P)RhCl_3$ (tris-(triphenylphosphine)rhodium chloride).

In the examples hereinbelow, a variety of different organosilicon compounds were used in preparing the compositions of the instant invention. Each organosilicon compound is delineated below and is designated by a corresponding letter. The letters then appear in Tables I and II below thus designating the type of organosilicon compound employed.

A—a 9,500 cps vinyldimethylsiloxy-terminated polydimethylsiloxane.

B—a 40,000 cps polydimethylsiloxane having 30% pendant vinylmethylsiloxy moieties.

C1—Silicone in water emulsion of 65 micron diameter particle size containing vinyldimethylsiloxy-terminated poly((3,3,3-trifluoropropyl)methylsiloxy)pentasiloxane.

C2—Silicone in water emulsion of 2 micron diameter particle size containing vinyldimethylsiloxy-terminated poly((3,3,3-trifluoropropyl)methylsiloxy)pentasiloxane.

D—Silicone in water emulsion containing 30,000 cps vinylmethylsiloxy-terminated polydimethylsiloxane having 30% (3,3,4,4,5,5,6,6,6-nonafluorobutyl)methylsiloxy moieties.

E—Silicone in water emulsion containing vinyldimethylsiloxy-terminated polydimethyldodecasiloxane having 40% (3,3,3-trifluoropropyl)methylsiloxy moieties.

F—Silicone in water emulsion containing 10,000 cps vinylmethylsiloxy-terminated polydimethylsiloxane having 30% (3,3,4,4,5,5,6,6,6-nonafluorobutyl)methylsiloxy moieties.

G—Silicone in water emulsion containing dimethylhydridosiloxy-terminated poly((3,3,3-trifluoropropyl)methylsiloxy)pentasiloxane.

H—Silicone in water emulsion containing 1,500,000 cps dimethylhydroxysiloxy-terminated polydimethylsiloxane.

I—Silicone in water emulsion containing 12,500 cps dimethylhyroxysiloxy-terminated polydimethylsiloxane.

J—Silicone in water emulsion containing 4,000 cps dimethylhydroxysiloxy-terminated dimethyl(aminoethylaminopropyl)methyl siloxane.

K—a 250 cps polydimethylsiloxane having 8% pendant alkylsulfocarboxy moieties.

EXAMPLES 1-10

In order to illustrate the effectiveness of the compositions of the present invention the following tests were conducted. Two_catalysts were prepared, a rhodium catalyst and a microencapsulated curing catalyst. A .03 molar rhodium catalyst solution was prepared by dissolving 1 gram of $RhCl_3 \bullet 6H_2O$ (rhodium trichloride hexahydrate) or TPRh in 120 grams of THF, THFA, or linallyl acetate. A 10% and 1% platinum catalyst solution was prepared by dissolving 10 grams and 1 gram, respectively, of a platinum catalyst prepared according to Example 3 of U.S. Pat. No. 5,194,460 in 90 grams and 99 grams, respectively, of linallyl acetate.

Into a glass container was added the acetate material. With gentle mixing using a round edge three blade turbine mixing impeller, one of the catalyst solutions prepared above was added to the acetate and mixed until the mixture was homogenous. Next, a mixture of 100 grams of a trimethylsilyl terminated polymethylhydrogensiloxane having a viscosity of 30 centistokes at a temperature of 25° C. and having the formula $Me_3SiO(MeHSiO)_{70}SiMe_3$ and an amount of an organosilicon compound (denoted in Table I hereinbelow) was added to the mixture and stirred gently until the mixture was again homogenous. This was followed by adding about 1.78 grams of a polyoxyethylene lauryl ether surfactant or a methylene chloride solvent (in Example 7 a solvent was substituted for the surfactant), and about 38 grams of water containing up to about 0.22 grams of a preservative (sorbic acid) to the mixture. Mixing was then resumed at medium speed for 20 to 30 minutes. The mixture was then processed through a high shear device to produce the emulsions of the instant invention. The particle sizes of the emulsions ranged from 0.7 to 3.0 microns and the pH of the emulsions ranged from 3.0 to 4.5.

A relative ranking from 1 to 10 was established using known commercial finishes based upon slickness values obtained using the Staple Pad Friction frictional test described hereinabove. No finish was given a ranking of 1, the commercial finish was given a ranking of 6, and a premium finish was given a ranking of 10. The amount of organosilicon compound, organosilicon compound type, the amount of linallyl acetate, the amount of catalyst, catalyst type, the time it took each sample to cure in minutes (min.), and the performance of each example are reported in Table I hereinbelow.

TABLE I

| | Organosilicon Compound | | | | | | |
|---|---|---|---|---|---|---|---|
| Example | Type | Amount (g) | Linallyl Acetate (g) | Catalyst (g) | Catalyst Type | Cure (Min.) | Rating |
| 1 | A | 10 | 10 | 0.1 | $RhCl_3$, THF | 5 | 10 |
| 2 | C1 | 3 | 3 | 0.1 | $RhCl_3$, THF | 10 | 10 |
| 3 | C2 | 3 | 3 | 0.1 | $RhCl_3$, THF | 10 | 8 |
| 4 | A | 10 | 10 | 0.3 | 10% Pt, Linallyl | 8 | 11 |
| 5 | B | 10 | 0 | 0.3 | 1% Pt, Linallyl | 3 | 11 |
| 6 | D | 2.5 | 0 | 0.3 | 1% Pt, Linallyl | 15 | 9 |
| 7 | E | 3 | 0 | 0.3 | 1% Pt, Linallyl | 10 | 9 |
| 8 | F | 3 | 0 | 0.3 | 1% Pt, Linallyl | 10 | 11 |
| 9 | G | 2 | 0 | 0.3 | 1% Pt, Linallyl | 14 | 11 |
| 10 | K | 10 | 4 | 0.1 | $RhCl_3$, THFA | 10 | 10 |

The examples in Table I hereinabove show that the organosilicon compounds of the instant invention cure into fiber treatment compositions to give good slickness ratings.

EXAMPLES 11-13

Another fiber treatment composition was prepared by preparing a first solution by mixing 33 grams of a trimethylsilyl terminated polymethylhydrogensiloxane having a viscosity of 30 centistokes at a temperature of 25° C. and having the formula $Me_3SiO(MeHSiO)_{70}SiMe_3$, 2 grams of linallyl acetate, and 0.03 grams of TPRh with 60 grams of water containing 4.8 grams of a nonionic polyoxyethylene lauryl ether surfactant and stirring. This mixture was then subjected to high shear until the desired emulsion particle size was attained.

A second solution was prepared by mixing 35 grams of an organosilicon compound (denoted in Table II) with 60 grams of water containing 4.8 grams of a nonionic polyoxyethylene lauryl ether surfactant and about 0.3 grams of a preservative (sorbic acid) and stirring. This mixture was then subjected to high shear until the desired emulsion particle size was attained.

In examples 11 and 12, 10 parts of the first solution was mixed with 90 parts of the second solution and the resulting mixture was stirred. In example 13, 3 parts of the first solution was mixed with 97 parts of the second solution and the resulting mixture was stirred. The typical particle size of the emulsions was below 300 nm and the pH ranged from 3.0 to 9.5.

The examples were again ranked as described hereinabove. The organosilicon compound type, the time it took each sample to cure in minutes (min.), and the performance of each example are reported in Table II hereinbelow.

TABLE II

| Example | Organosilicon Compound Type | Cure (Min.) | Rating |
|---|---|---|---|
| 11 | H | 10 | 11 |
| 12 | I | 10 | 12 |
| 13 | J | 10 | 10 |

Table II hereinabove shows that the compositions of the instant invention give excellent slickness ratings even when using a variety of catalyst types and different types of organosilicon compounds.

Comparixon Example 1

A first emulsion was prepared in the following manner. About 2 weight percent of an aqueous solution of a mixture of two partially hydrolyzed PVA's (polyvinyl alcohols) having a degree of hydrolysis of 88% and a 4% aqueous solution viscosity of 5 centipoise (cP) and 24 centipoise (cP) at 25° C., respectively, and about 0.3 weight percent of a polyoxyethylene (10) nonyl phenol surfactant was mixed with 28 weight percent of water. Next, 13.5 weight percent of an organohydrogenpolysiloxane having the formula $Me_3SiO(MeHSiO)_5(Me_2SiO)_3SiMe_3$, and 28 weight percent of a dimethylvinylsiloxy-terminated polydimethylmethylvinylsiloxane having a viscosity of 350 cP were mixed and stirred. Next, the PVA-surfactant mixture was added to the siloxane mixture and stirred. This mixture was then processed through a colloid mill and diluted with 28 weight percent of water containing a biocide to form an emulsion.

A second emulsion was prepared by mixing 2 weight percent of an aqueous solution of a mixture of two partially hydrolyzed PVA's (polyvinyl alcohols) having a degree of hydrolysis of 88% and a 4% aqueous solution viscosity of 5 centipoise (cP) and 24 centipoise (cP) at 25° C., respectively, about 0.3 weight percent of a polyoxyethylene (10) nonyl phenol surfactant, and 28 weight percent of water. Next, about 40 weight percent of dimethylvinylsiloxy-terminated polydimethylmethylvinylsiloxane having a viscosity of 350 cP and about 1% of a platinum-containing catalyst were mixed and stirred. Next, the PVA-surfactant mixture was added to the siloxane mixture and stirred. This mixture was then processed through a colloid mill and diluted with 28 weight percent of water containing a biocide to form an emulsion.

Next, 7.5 grams of the first emulsion, 7.5 grams of the second emulsion, and 85 grams of water were mixed together and the resulting emulsion stirred.

This silicone emulsion cured in 10 minutes and the sample was ranked according to the staple pad friction procedure delineated hereinabove. The silicone emulsion attained a rating of between 4 and 5.

Comparison Example 2

A silicone emulsion was prepared according to the disclosure of Bunge in U.S. Pat. No. 4,954,554. A first emulsion was prepared in the following manner. About 38 weight percent of a dimethylvinylsiloxy-terminated polydimethylsiloxane having a viscosity of 450 centistokes (cst) and 2 weight percent of a mixture of an organohydrogenpolysiloxane having the formula $Me_3SiO(MeHSiO)_5(Me_2SiO)_3SiMe_3$ and a dimethylsiloxanemethylhydrogensiloxane having a viscosity of 85 centistokes (cst) were mixed and stirred. About 2 weight percent of an aqueous solution of an intermediately hydrolyzed PVA having a degree of hydrolysis of 96% and a 4% aqueous solution viscosity of 30 centipoise (cP) at 25° C., a surfactant, and 29 weight percent of water were mixed and stirred. Next, the PVA-surfactant mixture was added to the siloxane mixture and stirred. This mixture was then processed through a colloid mill and diluted with 29 weight percent of water containing a biocide to form an emulsion.

A second emulsion was prepared by mixing about 2 weight percent of an aqueous solution of an intermediately hydrolyzed PVA having a degree of hydrolysis of 96% and a 4% aqueous solution viscosity of 30 centipoise (cP) at 25° C., a surfactant, and 51 weight percent of water. Next, about 40 weight percent of a dimethylvinylsiloxy-terminated polydimethylsiloxane having a viscosity of 450 cP and about 1% of a platinum-containing catalyst were mixed and stirred. Next, the PVA-surfactant mixture was added to the siloxane mixture and stirred. This mixture was then processed through a colloid mill and 7 weight percent of water containing a biocide was added to form an emulsion.

Next, 7.5 grams of the first emulsion, 7.5 grams of the second emulsion, and 85 grams of water were mixed together and the resulting emulsion stirred.

This silicone emulsion cured in 10 minutes and the sample was ranked according to the staple pad friction procedure delineated hereinabove. The silicone emulsion attained a rating of between 5 and 6. Thus the compositions of the instant invention outperformed the silicone emulsion previously described in the art.

It should be apparent from the foregoing that many other variations and modifications may be made in the compounds, compositions and methods described herein without departing substantially from the essential features and concepts of the present invention. Accordingly it should be clearly understood that the forms of the invention described herein are exemplary only and are not intended as limitations on the scope of the present invention as defined in the appended claims.

What is claimed is:

1. A fiber treatment composition comprising:
(A) an allyl ester, vinyl ester, or unsaturated acetate;
(B) at least one organohydrogensiloxane;
(C) a metal catalyst; and
(D) an organosilicon compound having an average of at least one group per molecule selected from the group consisting of carboxy groups, ester groups, amino groups, sulfo groups, acrylate groups, epoxy groups, ether groups, and mixtures thereof.

2. A fiber treatment composition comprising:
(A) an allyl ester, vinyl ester, or unsaturated acetate;
(B) at least one organohydrogensiloxane;
(C) a metal catalyst;
(D) an organosilicon compound having an average of at least one group per molecule selected from the group consisting of hydroxy groups, carboxy groups, ester groups, amino groups, acetoxy groups, sulfo groups, alkoxy groups, acrylate groups, epoxy groups, fluoro groups, ether groups, olefinic hydrocarbon or halohydrocarbon radicals having from 2 to 20 carbon atoms, and mixtures thereof; and (E) a dispersant selected from the group consisting of:

(i) surfactants; and (ii) a solvent selected from the group consisting of methylene chloride, acetonitrile, toluene, xylene, white spirits, and chlorinated hydrocarbons.

3. A composition according to claim 2, wherein the composition further comprises water.

4. A composition according to claim 2, wherein (A) is selected from the group consisting of allyl acetate, linallyl acetate, and isopropenyl acetate.

5. A composition according to claim 2, wherein (B) is selected from the group consisting of bis(trimethylsiloxy)dimethyldihydrogendisiloxane, diphenyldimethyldisiloxane, diphenyltetrakis(dimethylsiloxy)disiloxane, heptamethylhydrogentrisiloxane, hexamethyldihydrogentrisiloxane, methylhydrogencyclosiloxanes, methyltris(dimethylhydrogensiloxy)silane, pentamethylpentahydrogencyclopentasiloxane, pentamethylhydrogendisiloxane, phenyltris(dimethylhydrogensiloxy)silane, polymethylhydrogensiloxane, tetrakis(dimethylhydrogensiloxy)silane, tetramethyltetrahydrogencyclotetrasiloxane, tetramethyldihydrogendisiloxane, and methylhydrogendimethylsiloxane copolymers.

6. A composition according to claim 2, wherein (C) is selected from the group consisting of $RhCl_3$, $ClRh(PPh_3)_3$, $H_2PtCl_6$, a complex of 1,3-divinyl tetramethyl disiloxane and $H_2PtCl_6$, and alkyne complexes of $H_2PtCl_6$.

7. A composition according to claim 2, wherein (C) is a microencapsulated curing catalyst.

8. A composition according to claim 2, wherein (D) is a compound having its formula selected from the group consisting of (i) $R^1{}_3SiO(R_2SiO)_x(R^1RSiO)_ySiR^1{}_3$ (ii) $R_2R^1SiO(R_2SiO)_x(R^1RSiO)_ySiR_2R^1$ (iii) $RR^1{}_2SiO(R_2SiO)_x(R^1RSiO)_ySiRR^1{}_2$ wherein R is a monovalent hydrocarbon or halohydrocarbon radical having from 1 to 20 carbon atoms, $R^1$ is a group selected from the group consisting of hydroxy, hydroxyalkyl, hydroxyaryl, hydroxycycloalkyl, hydroxycycloaryl, carboxy, carboxyalkyl, carboxyaryl, carboxycycloalkyl, carboxycycloaryl, alkylester, arylester, cycloalkylester, cycloarylester, amino, aminoalkyl, aminoaryl, aminocycloalkyl, aminocycloaryl, acetoxy, acetoxyalkyl, acetoxyaryl, acetoxycycloalkyl, acetoxycycloaryl, sulfoalkyl, sulfoaryl, sulfocycloalkyl, sulfocycloaryl, alkoxy, alkoxyalkyl, alkoxyaryl, alkoxycycloalkyl, alkoxycycloaryl, acryloxy, acryloxyalkyl, acryloxyaryl, acryloxycycloalkyl, acryloxycycloaryl, epoxy, epoxyalkyl, epoxyaryl, epoxycycloalkyl, epoxycycloaryl, fluoro, fluoroalkyl, fluoroaryl, fluorocycloalkyl, fluorocycloaryl, alkylether, arylether, cycloalkylether, cycloarylether, olefinic hydrocarbon or halohydrocarbon radicals having from 2 to 20 carbon atoms, and mixtures thereof, x has a value of 0 to 3000, and y has a value of 1 to 100.

9. A composition according to claim 8, wherein $R^1$ is selected from the group consisting of hydroxy, hydroxypropyl, hydroxybutyl, hydroxyphenyl, hydroxymethylphenyl, hydroxyethylphenyl, and hydroxycyclohexyl.

10. A composition according to claim 8, wherein $R^1$ is selected from the group consisting of amino, aminopropyl, ethylene diaminopropyl, aminophenyl, aminooctadecyl, aminocyclohexyl, propylene diaminopropyl, dimethylamino, and diethylamino.

11. A composition according to claim 8, wherein $R^1$ is selected from the group consisting of acetoxy, acetoxyethyl, acetoxypropyl, acetoxybutyl, acetoxyphenyl, and acetoxycyclohexyl.

12. A composition according to claim 8, wherein $R^1$ is selected from the group consisting of hydrogen sulfide, sulfopropyl, methylsulfopropyl, sulfophenyl, and methylsulfo.

13. A composition according to claim 8, wherein $R^1$ is selected from the group consisting of fluoro, fluoropropyl, fluorobutyl, 3,3,3-trifluoropropyl, and 3,3,4,4,5,5,6,6,6-nonafluorohexyl.

14. A composition according to claim 8, wherein $R^1$ is selected from the group consisting of methoxy, ethoxy, butoxy, tertiary-butoxy, propoxy, isopropoxy, methoxyphenyl, ethoxyphenyl, methoxybutyl, and methoxypropyl.

15. A composition according to claim 8, wherein $R^1$ is selected from the group consisting of epoxide, epichlorohydrin, ethylene oxide, epoxybutane, epoxycyclohexane, epoxy ethylhexanol, epoxy propanol, and epoxy resin groups.

16. A composition according to claim 8, wherein $R^1$ is selected from the group consisting of acryloxyethyl, acryloxyethoxy, acryloxypropyl, acryloxypropoxy, methacryloxyethyl, methacryloxyethoxy, methacryloxypropyl, and methacryloxypropoxy.

17. A composition according to claim 8, wherein $R^1$ is selected from the group consisting of methylethylether, methylpropylether, ethylmethylether, ethylethylether, ethylpropylether, methylphenylether, ethylphenylether, isopropylphenylether, tertiary-butylpropylether, methylcyclohexylether, and ethylcyclohexylether.

18. A composition according to claim 8, wherein $R^1$ is selected from the group consisting of carboxy, carboxymethyl, carboxyethyl, carboxypropyl, carboxybutyl, carboxyphenyl, carboxymethylphenyl, carboxyethylphenyl, and carboxycyclohexyl.

19. A composition according to claim 8, wherein $R^1$ is selected from the group consisting of ethyl acetate, methyl acetate, n-propyl acetate, n-butyl acetate, phenyl acetate, benzyl acetate, isobutyl benzoate, ethyl benzoate, ethyl propionate, ethyl stearate, ethyl trimethylacetate, methyl laurate, and ethyl palmitate.

20. A composition according to claim 8, wherein the olefinic hydrocarbon radicals are selected from the group consisting of vinyl and hexenyl radicals.

21. A composition according to claim 2, wherein (E) is selected from the group consisting of polyoxyethylene alkyl ether, polyoxyethylene alkylphenol ether, polyoxyethylene alkyl ester, polyoxyethylene sorbitan alkyl ester, polyethylene glycol, polypropylene glycol, polyoxyalkylene glycol modified polysiloxanes, alkyltrimethylammonium hydroxide, dialkyldimethylammonium hydroxide, methylpolyoxyethylene cocoammonium chloride, and diplmityl hydroxyethylammonium methosulfate, polyethoxyethers of nonyl phenol and octyl phenol, trimethylnol ethers of polyethylene glycols, monoesters of alcohols and fatty acids, ethoxylated amines, methylene chloride, and acetonitrile.

22. A method of making a fiber treatment composition comprising:

(I) mixing:

(A) an allyl ester, vinyl ester, or unsaturated acetate, (B) at least one organohydrogensiloxane, (C) a metal catalyst, and (D) an organosilicon compound having an average of at least one group per molecule selected from the group consisting of hydroxy groups, carboxy groups, ester groups, amino groups, acetoxy groups, sulfo groups, alkoxy groups, acrylate groups, epoxy groups, fluoro groups, ether groups, olefinic hydrocarbon or halohydrocarbon radicals having from 2 to 20 carbon atoms, and mixtures thereof, and (E) a dispersant selected from the group consisting of:

(i) surfactants; and (ii) a solvent selected from the group consisting of methylene chloride, acetonitrile, toluene, xylene, white spirits, and chlorinated hydrocarbons.

23. A method according to claim 22, wherein the method further comprises adding water to the mixture of step (I).

24. A method of making a fiber treatment composition comprising:

(I) mixing:

(i) an organosilicon compound having an average of at least one group per molecule selected from the group consisting of hydroxy groups, carboxy groups, ester groups, amino groups, acetoxy groups, sulfo groups, alkoxy groups, acrylate groups, epoxy groups, fluoro groups, ether groups, olefinic hydrocarbon or halohydrocarbon radicals having from 2 to 20 carbon atoms, and mixtures thereof, and (ii) a dispersant selected from the group consisting of:

(i) surfactants; and (ii) a solvent selected from the group consisting of methylene chloride, acetonitrile, toluene, xylene, white spirits, and chlorinated hydrocarbons;

(II) adding to the mixture of (I) a mixture of:

(iii) an allyl ester, vinyl ester, or unsaturated acetate, (iv) at least one organohydrogensiloxane, and (v) a metal catalyst.

25. A method according to claim 24, wherein the mixture of step (II) is emulsified prior to adding the mixture of (II) to the mixture of (I).

26. A method according to claim 24, wherein the method further comprises adding water to the mixture of step (II).

27. A composition according to claim 1, wherein (A) is selected from the group consisting of allyl butyrate, allyl acetate, linallyl acetate, allyl methacrylate, vinyl acetate, allyl acrylate, vinyl butyrate, isopropenyl acetate, vinyl trifluoroacetate, 2-methyl-1-butenyl acetate, vinyl 2-ethyl hexanoate, vinyl 3,5,5-tirmethylhexanoate, allyl 3-butenoate, bis-(2-methylallyl) carbonate, dially succinate, and ethyl diallylcarbamate.

28. A composition according to claim 2, wherein (A) is selected from the group consisting of allyl butyrate, allyl acetate, linallyl acetate, allyl methacrylate, vinyl acetate, allyl acrylate, vinyl butyrate, isopropenyl acetate, vinyl trifluoroacetate, 2-methyl-1-butenyl acetate, vinyl 2-ethyl hexanoate, vinyl 3,5,5-trimethylhexanoate, allyl 3-butenoate, bis-(2-methylallyl) carbonate, diallyl succinate, and ethyl diallylcarbamate.

* * * * *